US009611602B1

(12) United States Patent
Black et al.

(10) Patent No.: US 9,611,602 B1
(45) Date of Patent: Apr. 4, 2017

(54) METHOD AND APPARATUS FOR ANIMAL WASTE DISPOSAL

(71) Applicants: Joseph D. Black, Staten Island, NY (US); Andrew J. Mistler, III, Staten Island, NY (US)

(72) Inventors: Joseph D. Black, Staten Island, NY (US); Andrew J. Mistler, III, Staten Island, NY (US)

( * ) Notice: Subject to any disclaimer, the term of this patent is extended or adjusted under 35 U.S.C. 154(b) by 0 days.

(21) Appl. No.: 15/000,296

(22) Filed: Jan. 19, 2016

(51) Int. Cl.
*A01K 29/00* (2006.01)
*E01H 1/12* (2006.01)

(52) U.S. Cl.
CPC ..... *E01H 1/1206* (2013.01)

(58) Field of Classification Search
CPC ..... E01H 1/1206; E01H 2001/124; E01H 2001/128; E01H 2001/126
USPC ..... 294/1.3, 13, 25
See application file for complete search history.

(56) References Cited

U.S. PATENT DOCUMENTS 1,990,553 A * 2/1935 Hirsch ..... A41D 13/087 15/227
3,407,927 A * 10/1968 Jones ..... A47G 21/001 206/372
3,703,158 A 11/1972 Lemler
4,103,952 A 8/1978 Thompson
5,400,572 A 3/1995 Peck
5,441,017 A 8/1995 Lindsay
5,669,645 A * 9/1997 Chuang ..... E01H 1/1206 294/1.3
5,970,922 A * 10/1999 Lin ..... A01K 27/001 119/867
6,059,332 A * 5/2000 Beascoechea Inchaurraga ..... E01H 1/1206 294/1.3
6,086,123 A 7/2000 Sowinski
6,145,128 A * 11/2000 Suzuki ..... A41D 13/087 2/21
7,862,094 B1 * 1/2011 Lamont ..... A47L 13/52 294/1.3
7,976,083 B2 7/2011 Black et al.
8,292,338 B1 * 10/2012 Baghdasaryan ..... E01H 1/1206 294/1.3
2003/0131393 A1 * 7/2003 Votolato ..... A41D 13/081 2/16
2004/0222650 A1 * 11/2004 Colesanti ..... E01H 1/1206 294/1.3
2006/0180608 A1 * 8/2006 Edwards ..... A01K 27/006 222/105

(Continued)

*Primary Examiner* — Gabriela Puig
(74) *Attorney, Agent, or Firm* — Walter J. Tencza, Jr.

(57) ABSTRACT

An apparatus including a first jaw section having an end, a second jaw section having an end, and a tube section. The first jaw section and the second jaw section may be connected to the tube section so that the first jaw section and the second jaw section oppose each other and pivot with respect to the tube section. The apparatus may be configured so that it can be placed in a first state wherein the end of the first jaw section contacts the end of the second jaw section. The apparatus may be configured so that it can be placed in a second state wherein the end of the second jaw section does not contact the end of the first jaw section. The first and second jaw sections may include a first and second chambers, respectively, into which fingers or a thumb are inserted to pivot the jaw sections.

17 Claims, 10 Drawing Sheets

(56) References Cited

U.S. PATENT DOCUMENTS

2009/0261603 A1* 10/2009 Boghozian ..... E01H 1/1206
294/1.3

* cited by examiner

METHOD AND APPARATUS FOR ANIMAL WASTE DISPOSAL

FIELD OF THE INVENTION

This invention relates to improved methods and apparatus concerning animal waste disposal.

BACKGROUND OF THE INVENTION

There are various devices and methods known for animal waste disposal.

For example, U.S. Pat. No. 7,976,083 to Black et al., discloses an animal waste disposal system that includes a removal tool and a collection bag. In one embodiment of Black, a removal tool is fixed to a collection bag and thrown out with the collection bag. In another embodiment of Black, a collection bag is inserted into the removal tool and thereafter removed from the removal tool, and another collection bag is thereafter used.

SUMMARY OF THE INVENTION

In at least one embodiment a handheld pet pooper scooper and bag dispenser is provided.

In at least one embodiment an apparatus is provided comprising a first jaw section having an end, a second jaw section having an end, and a tube section. The first jaw section and the second jaw section may be connected to the tube section so that the first jaw section and the second jaw section oppose each other and pivot with respect to the tube section. The apparatus may be configured so that it can be placed in a first state wherein the end of the first jaw section contacts the end of the second jaw section. The apparatus may be configured so that it can be placed in a second state wherein the end of the second jaw section does not contact the end of the first jaw section.

The first jaw section may include a plurality of walls which partially enclose a first chamber. The first jaw section may have a first opening leading to the first chamber, and the first opening may allow the insertion of a thumb of a person's hand into the first chamber through the first opening. The second jaw section may include a plurality of walls which partially enclose a second chamber, and the second jaw section may have a second opening leading to the second chamber, and the second opening may allow the insertion of four fingers, other than the thumb, of the person's hand, into the second chamber through the second opening, while the thumb of the person's hand is inserted into the first chamber.

The tube section may include a cylindrical tube having a bottom, and wherein the first jaw section and the second jaw section are connected to the tube section so that the first jaw section and the second jaw section pivot parallel to the bottom of the cylindrical tube. The tube section may include a lid opposite the bottom of the cylindrical tube. The tube section may include a protrusion protruding upwards from the bottom of the cylindrical tube within an inner chamber of the cylindrical tube.

The tube section may include a cylindrical tube having a side which when unrolled is a rectangle, and wherein the side of the cylindrical tube has at least a first opening. The first jaw section may be connected to the tube section along a first line of the side of the cylindrical tube. The second jaw section may be connected to the tube section along a second line of the side of the cylindrical tube, which is parallel to but separated from the first line of the side of the cylindrical tube. The side of the cylindrical tube may have at least a second opening opposite the first opening.

In at least one embodiment, a method is provided which includes inserting a thumb of a person through a first opening into a first chamber of a first jaw section of an apparatus, inserting four fingers, other than the thumb of the person, through a second opening into a second chamber of a second jaw section of the apparatus, while the thumb is in the first chamber of the first jaw section; and using the thumb and the four fingers other than the thumb of the person to pivot the first jaw section and the second jaw section from a first state in which an end of the first jaw section does is in on position with respect to an end of the second jaw section into a second state in which the end of the first jaw section is closer to the end of the second jaw section to thereby pick up an object; wherein the first jaw section is connected to a tube section; and wherein the second jaw section is connected to the side of the tube section. The apparatus may have further features as previously described.

DETAILED DESCRIPTION OF THE DRAWINGS

Figure 7:
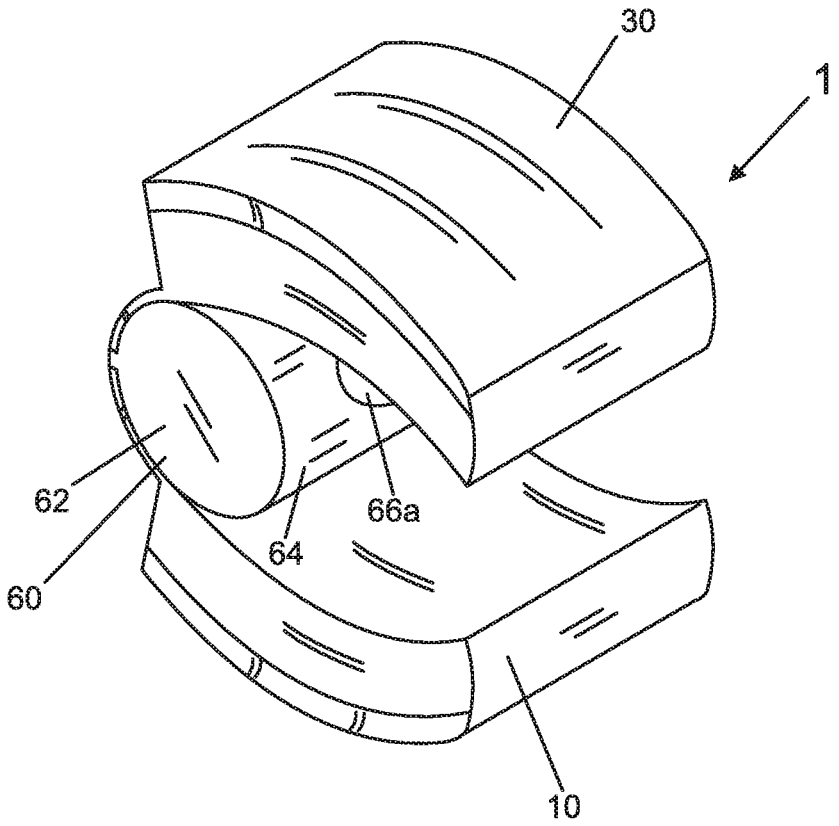
FIG. 7 shows a bottom, right side, and front perspective view of the apparatus of FIG. 1.
Figure 8:
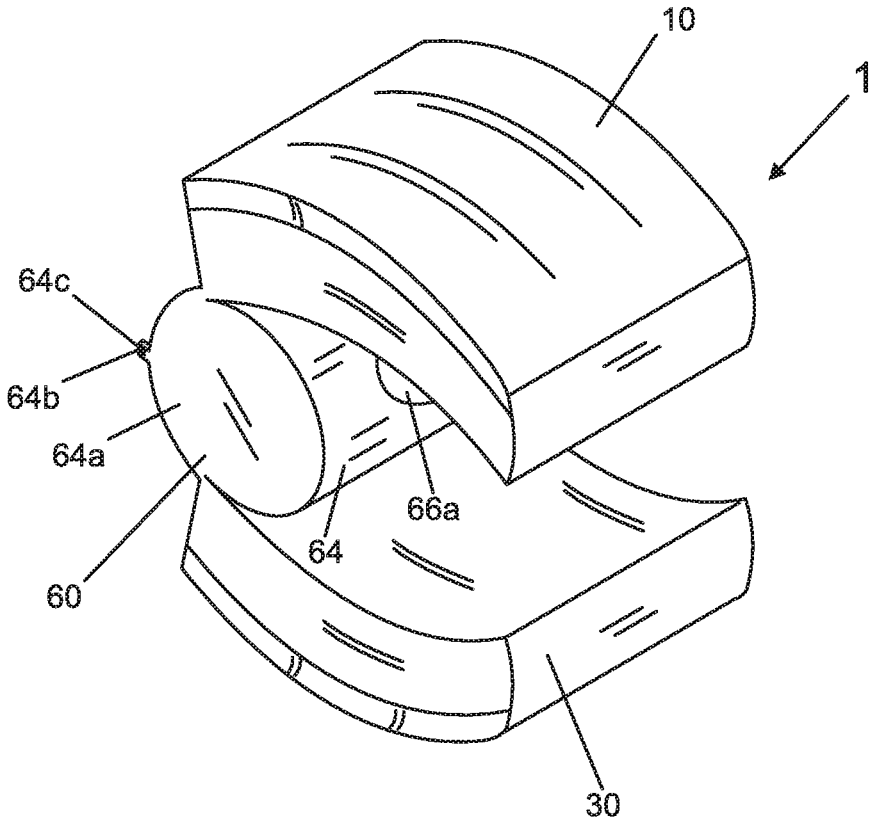
FIG. 8 shows a top, left side, and front perspective view of the apparatus of FIG. 1.
Figure 9:
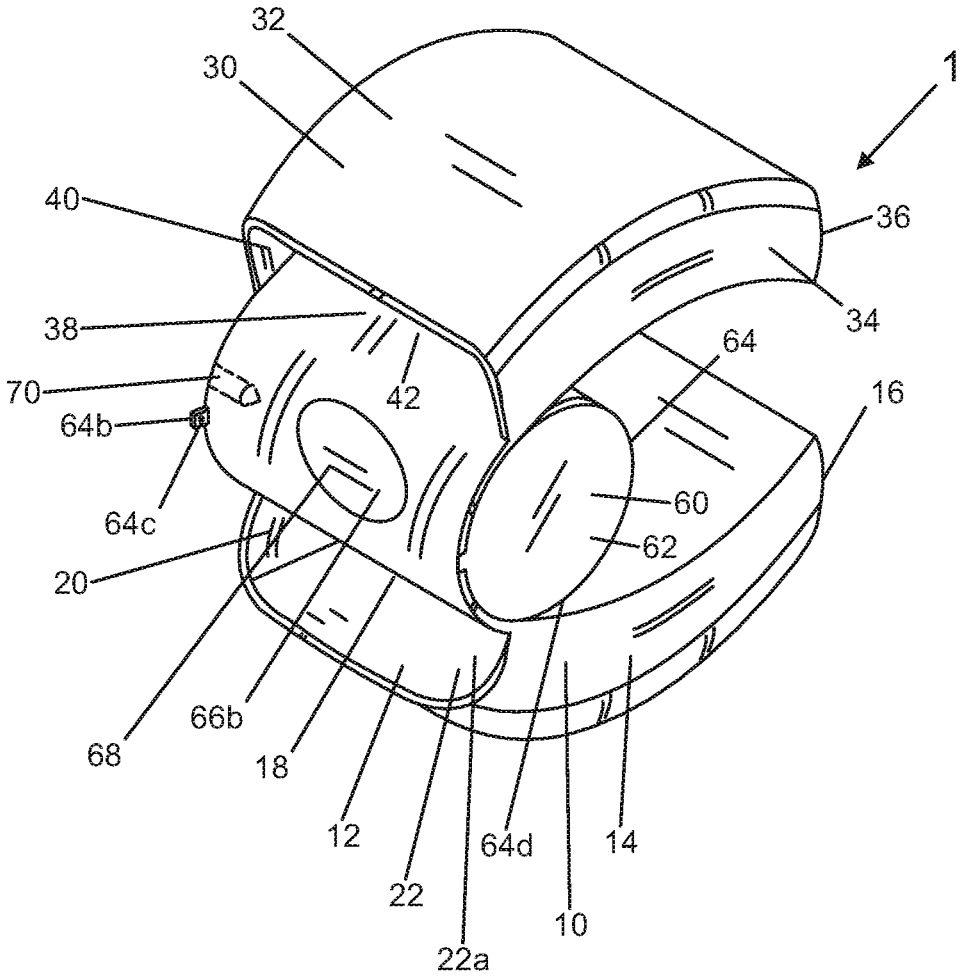
FIG. 9 shows a bottom, right side, and rear perspective view of the apparatus of FIG. 1.
Figure 10:
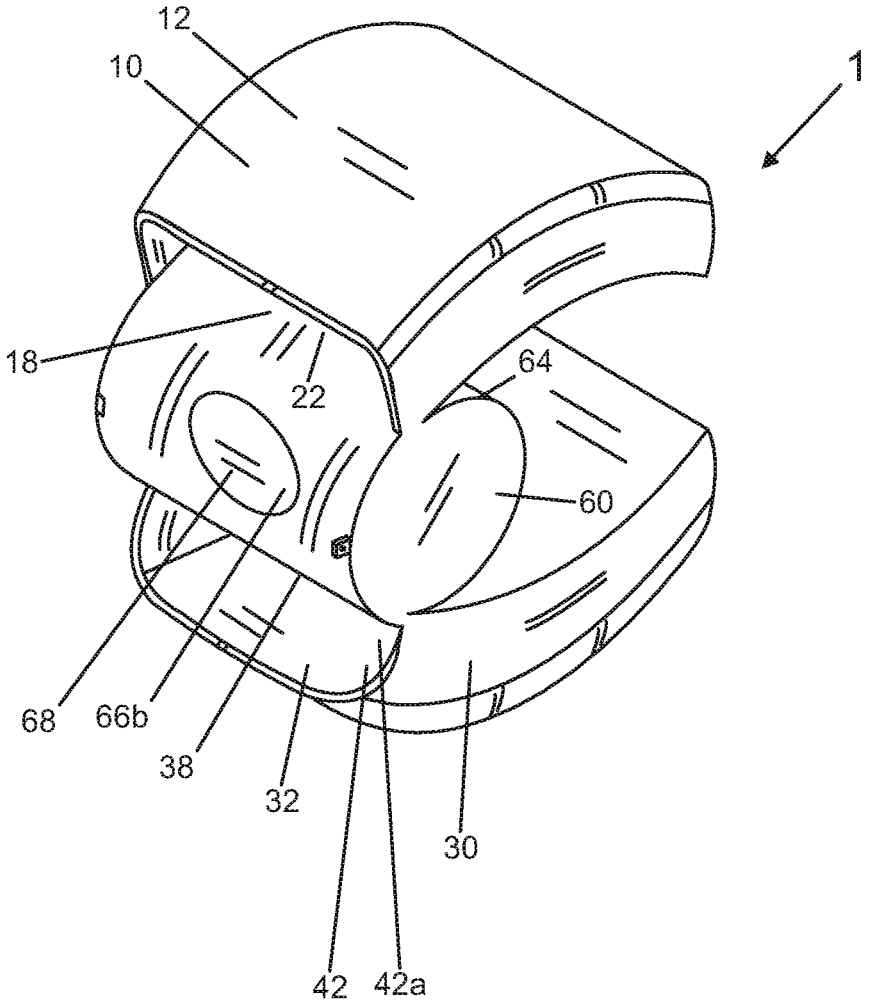
FIG. 10 shows a top, left side, and rear perspective view of the apparatus of FIG. 1.

FIGS. 1-6 show a right side, left side, front, rear, bottom, and top views, respectively, of an apparatus 1 in accordance with an embodiment of the present invention. FIG. 7 shows a bottom, right side, and front perspective view of the apparatus 1. FIG. 8 shows a top, left side, and front perspective view of the apparatus 1. FIG. 9 shows a bottom, right side, and rear perspective view of the apparatus 1. FIG. 10 shows a top, left side, and rear perspective view of the apparatus 1.

Referring to FIGS. 1-10, the apparatus 1 may include jaw or jaw section 10, jaw or jaw section 30, and container device or tube section 60. The jaw or jaw section 10 may include walls or sides 12, 14, 16, and 18 shown in FIG. 1 and side or wall 20 shown in FIG. 2. The jaw or jaw section 30 may include walls or sides 32, 34, 36, and 38 shown in FIG. 1 and side or wall 40 shown in FIG. 2.

Figure 1:
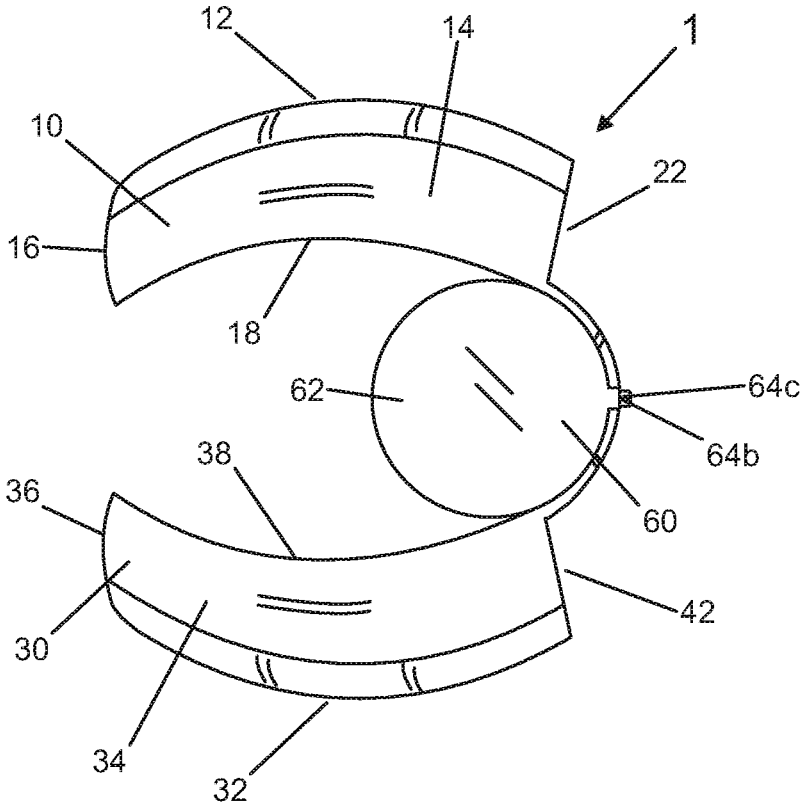
FIG. 1 shows a right side view of an apparatus in accordance with an embodiment of the present invention.
Figure 2:
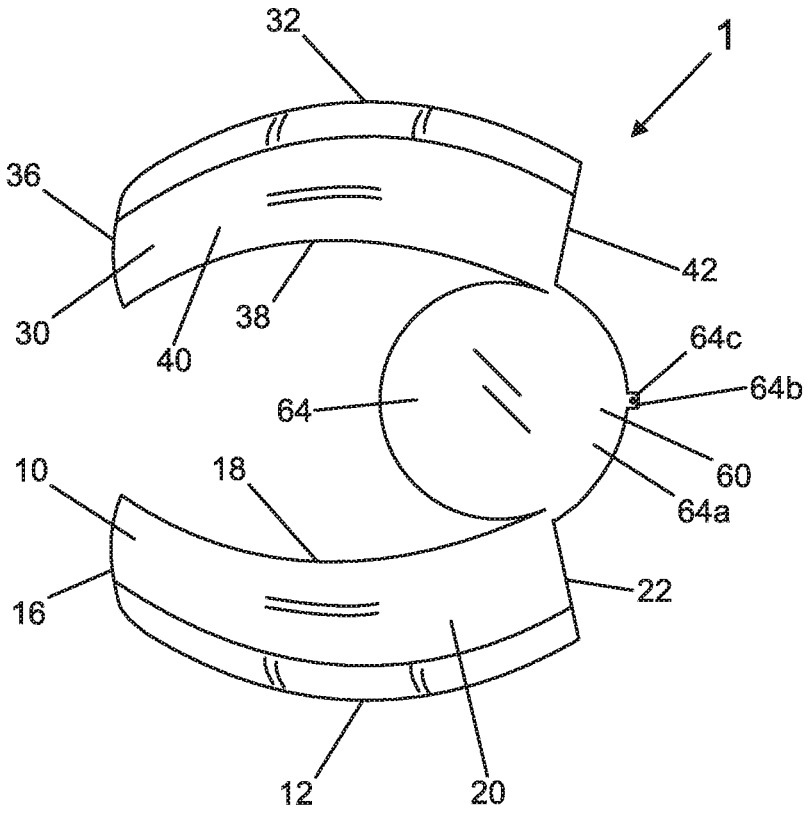
FIG. 2 shows a left side view of the apparatus of FIG. 1.
Figure 3:
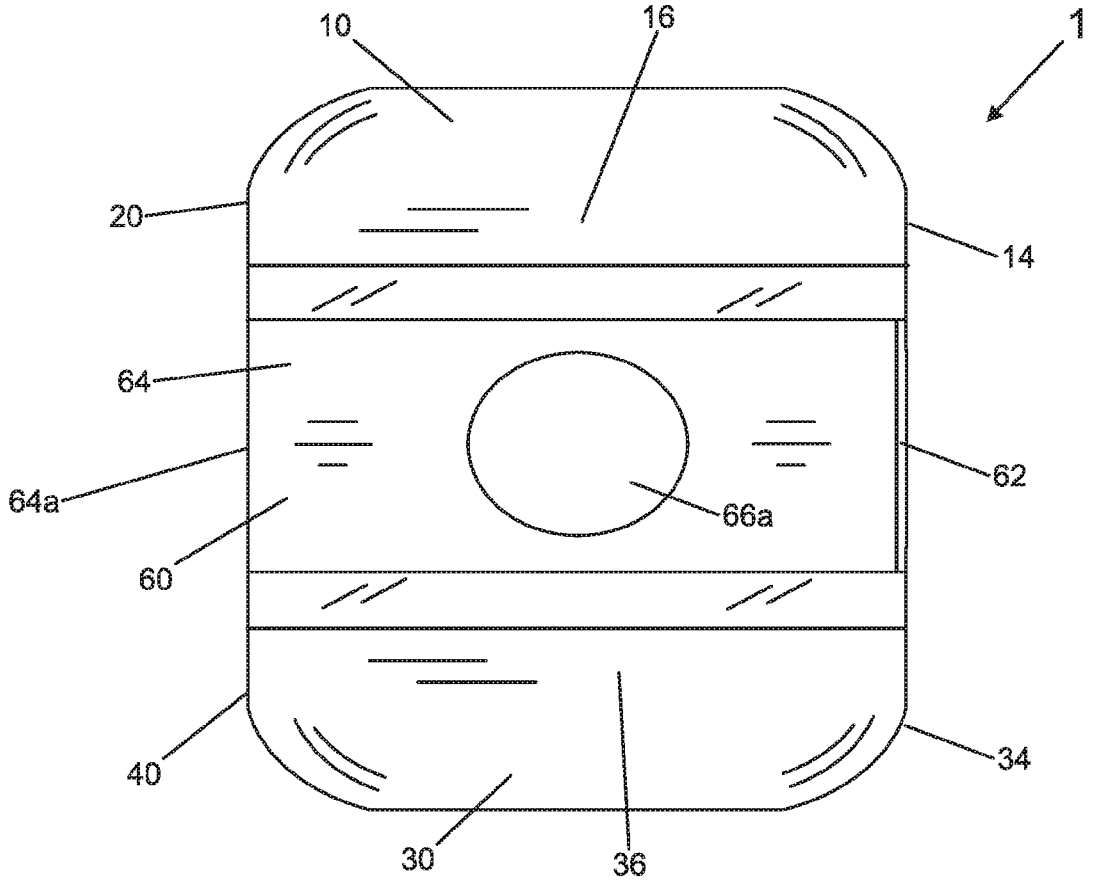
FIG. 3 shows a front view of the apparatus of FIG. 1.
Figure 4:
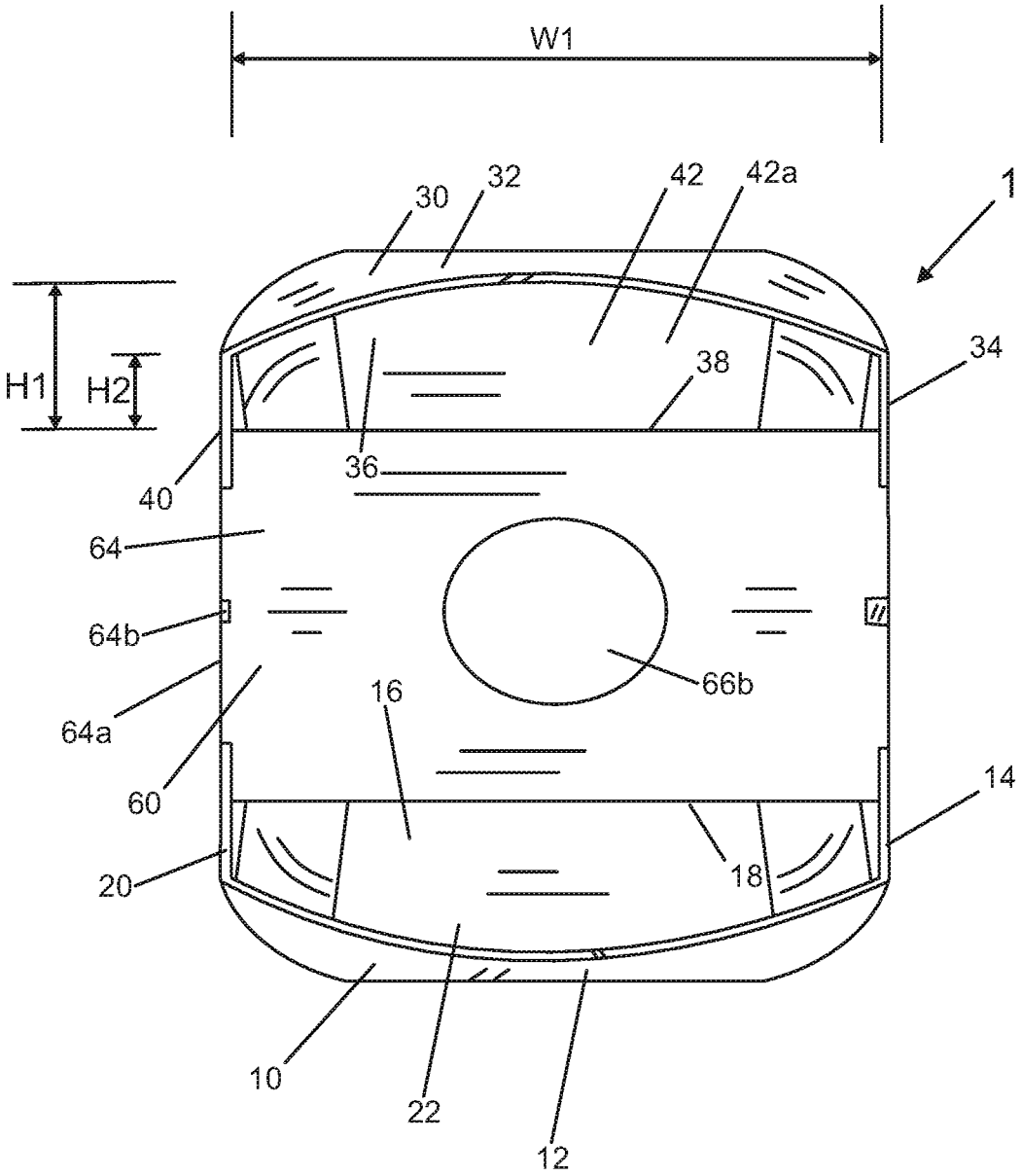
FIG. 4 shows a rear view of the apparatus of FIG. 1.

The jaw or jaw section 10 may have an inner chamber 22, in at least one embodiment, completely enclosed by walls or sides 12, 14, 16, 18, and 20, with the exception of opening 22*a* leading to the chamber 22, as shown by FIG. 4 and FIG. 9. The jaw or section 30 may have an inner chamber 42, in at least one embodiment, completely enclosed by walls or sides 32, 34, 36, 38, and 40, with the exception of opening 42*a* as shown by FIG. 4 and FIG. 10.

Figure 5:
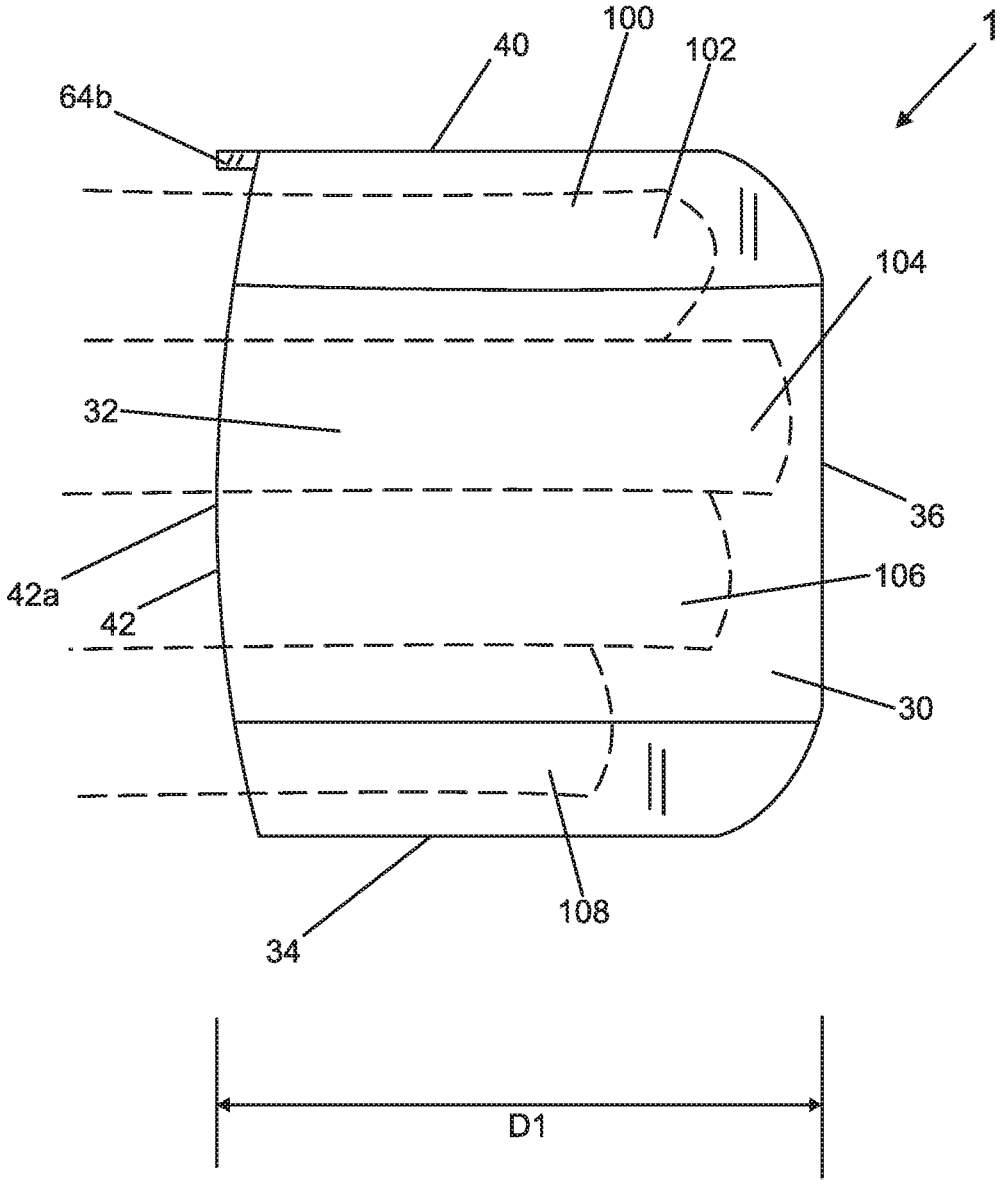
FIG. 5 shows a bottom view of the apparatus of FIG. 1, along with dashed lines representing four fingers of a human hand inserted into a chamber of the apparatus of FIG. 1.

The jaw or jaw section 10 may be integrated with the jaw or jaw section 30 by the wall or side 18 being integrated with the wall or section 38. As shown in FIG. 4, the opening 42*a* to the chamber 42, and the chamber 42 in general, may have a width, W1, of about three and one half inches, a maximum height H1 of about one inch, and a minimum height H2 of about one half of an inch. The depth D1 of the inner chamber 42 may be about three and one half inches as shown by FIG. 5. The opening 22*a* and the inner chamber 22 may have the same dimensions as the opening 42*a* and the inner chamber 42. The dimensions of inner chambers 22 and 42 and openings 22*a* and 42*a* are sufficient to allow four fingers to be inserted into either of the inner chambers 22 and 42 as shown in FIG. 5, for inner chamber 42, by dashed lines representing hand 100 having fingers 102, 104, 106, and 108 of a human hand (i.e. not including a thumb). In operation, four fingers of a human hand, not including the thumb, such as fingers 102, 104, 106, and 108 would be inserted into one chamber, such as chamber 42 as in FIG. 5, while simultaneously the thumb of the same human hand would be inserted into the other chamber, such as inner chamber 22 in this example. For example, thumb 110 of human hand 100, shown by dashed lines in FIG. 6 may be inserted into chamber 22 while fingers 102, 104, 106, and 108 are in chamber 42.

The container device or section 60 may be include a lid 62 and a cylinder 64. The cylinder 64 may have a closed bottom 64*a* shown in FIG. 2, and openings 66*a* and 66*b*, in the side of cylinder 64, shown by FIGS. 3, 4, and 7-10. The lid 62 may be opened to reveal a top opening 64*d* opposite the closed bottom 64*a*.

In at least one embodiment, plastic bags, such as plastic grocery shopping bags or other small compactible plastic bags can be inserted into the cylinder 64 by opening the lid 62 and inserting the bags through top opening 64*d*, when the lid 62 is removed or opened. The lid 62 may be any cap, such as a hinge cap, a screw on cap, or a push on cap.

The bags within a chamber of the cylinder 64, may be pulled out of either opening 66*a* or opening 66*b* in the side of the cylinder 64. In at least one embodiment, the cylinder 64 can hold a roll of approximately twenty bags.

Figure 6:
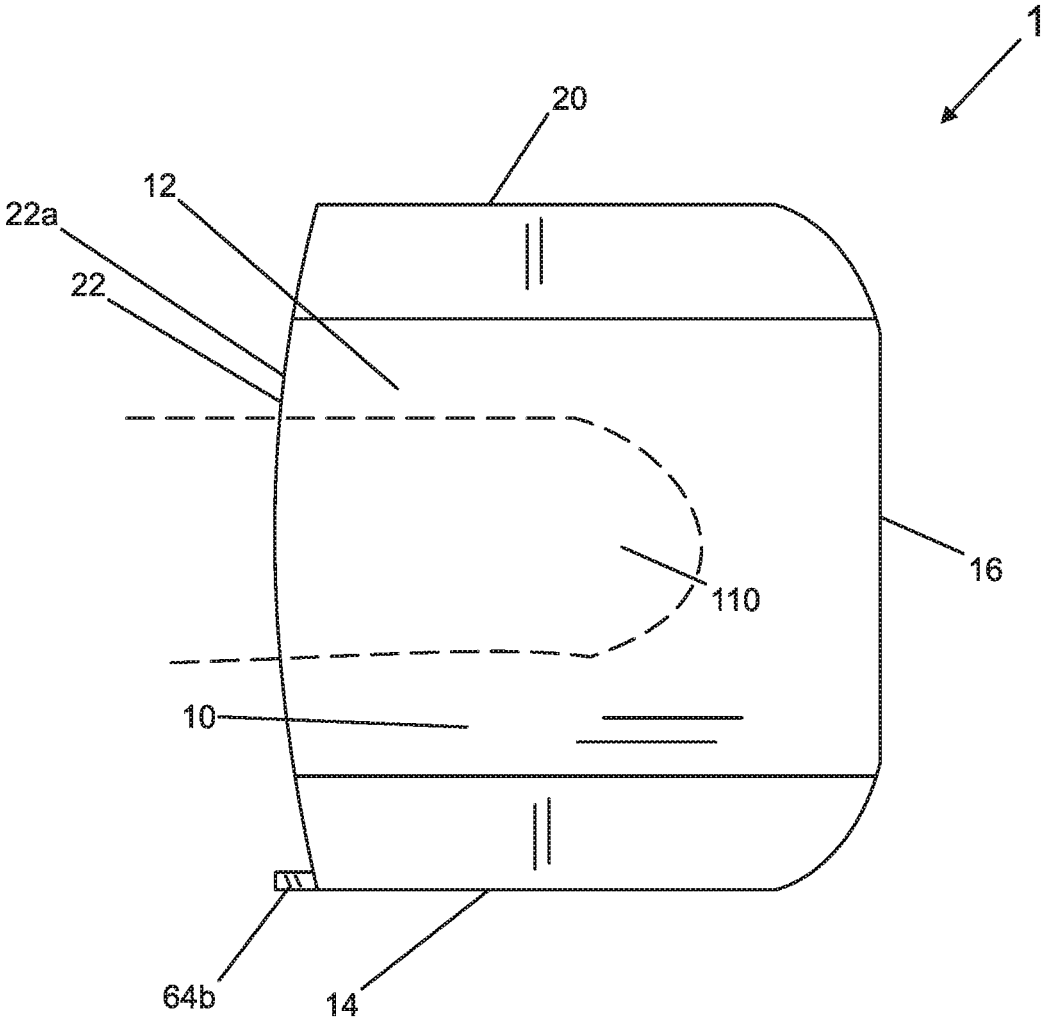
FIG. 6 shows a top view of the apparatus of FIG. 1, along with dashed lines representing a thumb of a human hand inserted into another chamber of the apparatus of FIG. 1.

In operation, a person would insert their four fingers 102, 104, 106, and 108 (not including the thumb) into one of the chambers such as chamber 42 and at the same time insert their thumb 110 into the other chamber, such as chamber 22 as shown by FIGS. 5 and 6. With the fingers 102, 104, 106, 108, and 110 located within the appropriate chamber as shown by FIGS. 5 and 6, the person would squeeze the sections or jaws 10 and 30 together until they came into contact at or near the junctions of sides 16 and 18 and sides 36 and 38. By squeezing the jaws 10 and 30 together the person will be able to pick up an object, such as for example waste from a dog, without actually touching the waste with the person's hand 100.

There is a protrusion 64*b* having an opening 64*c*,

The apparatus 1 may be completely made of polyurethane. The apparatus 1 may be made of another material such as another type of rigid plastic.

FIG. 9 shows dashed lines for an optional post or rod 70, which may be located inside of the inner chamber 68 of the cylinder 64, fixed to the closed bottom 64*a*. The rod 70 may be used to help hold plastic bags in the cylinder 64.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

We claim:

1. An apparatus comprising:

a first jaw section having a first end and a second end;

a second jaw section having a first end and a second end;

a tube section;

wherein the first jaw section and the second jaw section are connected to the tube section so that the first jaw section and the second jaw section oppose each other and pivot with respect to the tube section;

wherein the apparatus is configured so that it can be placed in a first state wherein the second end of the first jaw section contacts the second end of the second jaw section; and wherein the apparatus is configured so that it can be placed in a second state wherein the second end of the second jaw section does not contact the second end of the first jaw section;

wherein the first end of the first jaw section is fixed to and is in direct contact with the tube section at a first point;

wherein the first end of the second jaw section is fixed to and is in direct contact with the tube section at a second point different from the first point;

wherein the first jaw section has a depth, which measures a distance from the first end of the first jaw section to the second end of the first jaw section;

wherein the second jaw section has a depth, which measures a distance from the first end of the second jaw section to the second end of the second jaw section;

wherein the first jaw section has a width;

wherein the second jaw section has a width;

wherein the width of the first jaw section measures substantially the same as the width of the second jaw section;

wherein the depth of the first jaw section measures substantially the same as the depth of the second jaw section;

wherein the width of the first jaw section is substantially perpendicular to the depth of the first jaw section;

wherein the width of the second jaw section is substantially perpendicular to the depth of the second jaw section;

wherein the width of the first jaw section measures substantially the same as the depth of the first jaw section; and wherein the width of the second jaw section measures substantially the same as the depth of the second jaw section; wherein the first jaw section includes a plurality of walls which partially enclose a first chamber; wherein the first jaw section has a first opening leading to the first chamber, and the first opening allows the insertion of a thumb of a person's hand into the first chamber through the first opening; wherein the second jaw section includes a plurality of walls which partially enclose a second chamber; and wherein the second jaw section has a second opening leading to the second chamber, and the second opening allows the insertion of four fingers, other than the thumb, of the person's hand, into the second chamber through the second opening, while the thumb of the person's hand is inserted into the first chamber.

2. The apparatus of claim 1 wherein the tube section includes a cylindrical tube having a bottom, and wherein the first jaw section and the second jaw section are connected to the tube section so that the first jaw section and the second jaw section pivot parallel to the bottom of the cylindrical tube.

3. The apparatus of claim 2 wherein the tube section includes a rod, located inside of an inner chamber of the cylindrical tube, fixed to a closed bottom of the cylindrical tube, protruding inwards into the inner chamber from the closed bottom of the cylindrical.

4. The apparatus of claim 1 wherein the tube section includes a lid opposite a bottom of a cylindrical tube.

5. The apparatus of claim 1 wherein the tube section includes a cylindrical tube having a side which when unrolled is a rectangle, and wherein the side of the cylindrical tube has at least a first opening;

wherein the first opening of the cylindrical tube is between the first end of the first jaw section and the first end of the second jaw section;

wherein the first end of the first jaw section, the first end of the second jaw section, the second end of the first jaw section, and the second end of the second jaw section are all located on a same first side of the first opening, when the second end of the first jaw section contacts the second end of the second jaw section;

wherein the first jaw section is connected to the tube section along a first line of the side of the cylindrical tube;

and wherein the second jaw section is connected to the tube section along a second line of the side of the cylindrical tube, which is parallel to but separated from the first line of the side of the cylindrical tube.

6. The apparatus of claim 5 wherein the side of the cylindrical tube has at least a second opening opposite the first opening.

7. The apparatus of claim 1 wherein the first jaw section includes a curved surface which curves from the first end of the first jaw section to the second end of the first jaw section;

the second jaw section includes a curved surface which curves from the first end of the second jaw section to the second end of the second jaw section;

wherein the curved surfaces of the first jaw section and the second jaw section are configured to contact and hold an object between the curved surface of the first jaw section and the curved surface of the second jaw section;

wherein the curved surface of the first jaw section gradually curves towards the second jaw section, from the first end of the first jaw section to the second end of the first jaw section; and wherein the curved surface of the second jaw section gradually curves towards the first jaw section, from the first end of the second jaw section to the second end of the second jaw section.

8. The apparatus of claim 7 wherein the curved surface of the first jaw section conforms to a curvature of the tube section at the first end of the first jaw section; and the curved surface of the second jaw section conforms to a curvature of the tube section at the first end of the second jaw section.

9. The apparatus of claim 1 wherein the apparatus is entirely made of a rigid plastic.

10. A method comprising inserting a thumb of a person through a first opening into a first chamber of a first jaw section of an apparatus;

inserting four fingers, other than the thumb of the person, through a second opening into a second chamber of a second jaw section of the apparatus, while the thumb is in the first chamber of the first jaw section;

using the thumb and the four fingers other than the thumb of the person to pivot the first jaw section and the second jaw section from a first state in which an end of the first jaw section is in one position with respect to an end of the second jaw section into a second state in which the end of the first jaw section is closer to the end of the second jaw section to thereby pick up an object;

wherein a first end of the first jaw section is connected to a tube section;

wherein a first end of the second jaw section is connected to the tube section;

wherein the first end of the first jaw section is fixed to and is in direct contact with the tube section at a first point;

wherein the first end of the second jaw section is fixed to and is in direct contact with the tube section at a second point different from the first point;

wherein the first jaw section has a depth, which measures a distance from the first end of the first jaw section to a second end of the first jaw section;

wherein the second jaw section has a depth, which measures a distance from the first end of the second jaw section to a second end of the second jaw section;

wherein the first jaw section has a width;

wherein the second jaw section has a width;

wherein the width of the first jaw section measures substantially the same as the width of the second jaw section;

wherein the depth of the first jaw section measures substantially the same as the depth of the second jaw section;

wherein the width of the first jaw section is substantially perpendicular to the depth of the first jaw section;

wherein the width of the second jaw section is substantially perpendicular to the depth of the second jaw section;

wherein the width of the first jaw section measures substantially the same as the depth of the first jaw section;

wherein the width of the second jaw section measures substantially the same as the depth of the second jaw section;

wherein the first jaw section includes a curved surface which curves from the first end of the first jaw section to the second end of the first jaw section;

the second jaw section includes a curved surface which curves from the first end of the second jaw section to the second end of the second jaw section;

wherein the curved surfaces of the first jaw section and the second jaw section are configured to contact and hold an object between the curved surface of the first jaw section and the curved surface of the second law section;

wherein the curved surface of the first jaw section gradually curves towards the second jaw section, from the first end of the first jaw section to the second end of the first jaw section; and wherein the curved surface of the second jaw section gradually curves towards the first jaw section, from the first end of the second jaw section to the second end of the second jaw section;

wherein the curved surface of the first jaw section conforms to a curvature of the tube section at the first end of the first jaw section; and the curved surface of the second jaw section conforms to a curvature of the tube section at the first end of the second jaw section.

11. The method of claim 10 wherein the first jaw section includes a plurality of walls which partially enclose the first chamber; and wherein the second jaw section includes a plurality of walls which partially enclose the second chamber.

12. The method of claim 10 wherein the tube section includes a cylindrical tube having a bottom, and wherein the first jaw section and the second jaw section are connected to the tube section so that the first jaw section and the second jaw section pivot parallel to the bottom of the cylindrical tube.

13. The method of claim 12 wherein the tube section includes a rod located inside of an inner chamber of the cylindrical tube, fixed to a closed bottom of the cylindrical tube, protruding inwards in the inner chamber from the closed bottom of the cylindrical tube.

14. The method of claim 10 wherein the tube section includes a lid opposite a bottom of a cylindrical tube.

15. The method of claim 10 wherein the tube section includes a cylindrical tube having a side which when unrolled is a rectangle, and wherein the side of the cylindrical tube has at least a first opening;

wherein the first opening of the cylindrical tube is between the first end of the first jaw section and the first end of the second jaw section;

wherein the first end of the first jaw section, the first end of the second jaw section, the second end of the first jaw section, and the second end of the second jaw section are all located on a same first side of the first opening, when the second end of the first jaw section contacts the second end of the second jaw section;

wherein the first jaw section is connected to the tube section along a first line of the side of the cylindrical tube; and wherein the second jaw section is connected to the tube section along a second line of the side of the cylindrical tube, which is parallel to but separated from the first line of the side of the cylindrical tube.

16. The method of claim 15 wherein the side of the cylindrical tube has at least a second opening opposite the first opening.

17. The method of claim 10, wherein the curved surface of the first jaw section conforms to a curvature of the tube section at the first end of the first jaw section; and the curved surface of the second jaw section conforms to a curvature of the tube section at the first end of the second jaw section.

* * * * *